US009823598B2

(12) United States Patent
Kamijo et al.

(10) Patent No.: US 9,823,598 B2
(45) Date of Patent: Nov. 21, 2017

(54) CONDUCTIVE MEMBER, PROCESS CARTRIDGE, AND IMAGE FORMING APPARATUS

(71) Applicant: FUJI XEROX CO., LTD., Tokyo (JP)

(72) Inventors: Yukiko Kamijo, Kanagawa (JP); Taketoshi Hoshizaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/228,000

(22) Filed: Aug. 4, 2016

(65) Prior Publication Data

US 2017/0277060 A1 Sep. 28, 2017

(30) Foreign Application Priority Data

Mar. 25, 2016 (JP) ..... 2016-062275

(51) Int. Cl.
*G03G 15/02* (2006.01)
*G03G 21/18* (2006.01)

(52) U.S. Cl.
CPC ..... *G03G 15/0233* (2013.01); *G03G 21/18* (2013.01)

(58) Field of Classification Search
CPC ..... G03G 15/0233; G03G 21/18
See application file for complete search history.

(56) References Cited

U.S. PATENT DOCUMENTS

2011/0002711 A1* 1/2011 Wada ..... G03G 15/0233 399/176

FOREIGN PATENT DOCUMENTS

JP 2002-278218 A 9/2002
JP 2011-95546 A 5/2011

* cited by examiner

*Primary Examiner* — Gregory H Curran
(74) *Attorney, Agent, or Firm* — Sughrue Mion, PLLC

(57) ABSTRACT

A conductive member includes a substrate, an elastic layer on the substrate, and a surface layer on the elastic layer. The surface layer contains a resin and insulating particles. The insulating particles account for 50% or more and 70% or less of an area of a cross-section of the surface layer taken in a thickness direction.

9 Claims, 6 Drawing Sheets

CONDUCTIVE MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-062275 filed Mar. 25, 2016.

BACKGROUND (i) Technical Field

The present invention relates to a conductive member, a process cartridge, and an image forming apparatus.

(ii) Related Art

An electrophotographic image formation involves forming an electrostatic latent image on a surface of a photoreceptor by charging and exposing, forming a toner image by developing the electrostatic latent image with a charged toner, transferring the toner image onto a recording medium such as a paper sheet, and fixing the toner image onto the recording medium. An image forming apparatus used for image forming is equipped with a conductive member that serves as a charging unit or a transfer unit.

SUMMARY

According to an aspect of the invention, a conductive member includes a substrate, an elastic layer on the substrate, and a surface layer on the elastic layer. The surface layer contains a resin and insulating particles. The insulating particles account for 50% or more and 70% or less or about 50% or more and about 70% or less of an area of a cross-section of the surface layer taken in a thickness direction.

BRIEF DESCRIPTION OF THE DRAWINGS

Exemplary embodiments of the present invention will be described in detail based on the following figures, wherein.

DETAILED DESCRIPTION

Figure 1:
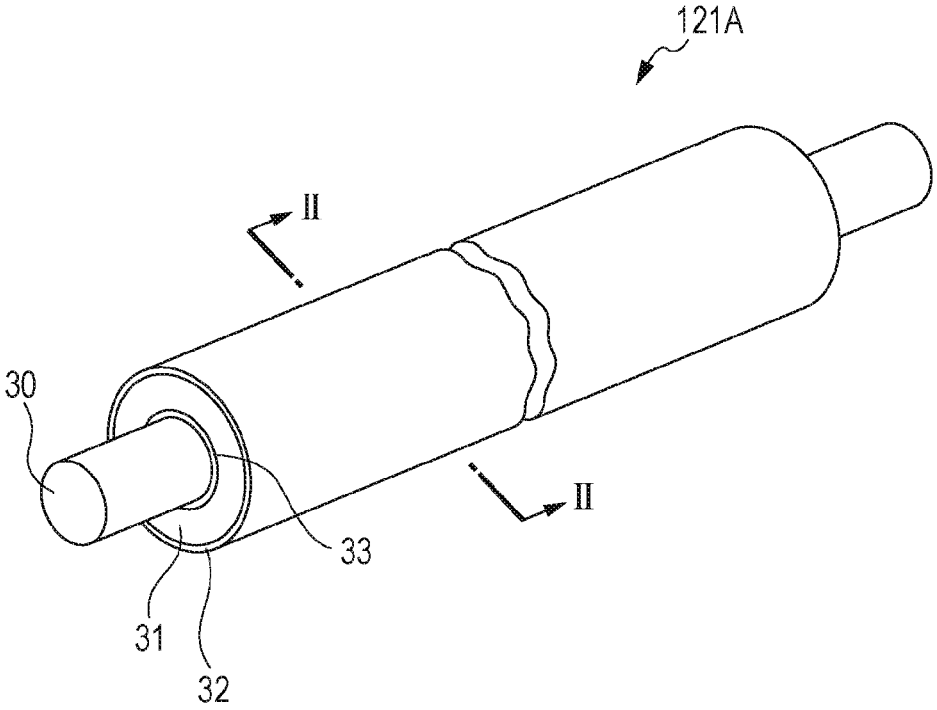
FIG. 1 is a schematic perspective view illustrating an example of a conductive member according to an exemplary embodiment.

Exemplary embodiments which are illustrative examples of the present invention are described in detail below.

Conductive Member

A conductive member according to an exemplary embodiment includes a substrate, an elastic layer on the substrate, and a surface layer on the elastic layer. The surface layer contains a resin and insulating particles. The insulating particles account for 50% or more and 70% or less or about 50% or more and about 70% or less of the area of a cross section of the surface layer taken in a thickness direction (hereinafter this ratio may also be referred to as the "area fraction of insulating particles"). For the purposes of this description, "insulating" means that the volume resistivity at 20° C. is $1\times10^{14}$ Ω·cm or more.

Since the conductive member according to the exemplary embodiment has the above-described features, resistance non-uniformity caused by contamination with insulating contaminants is suppressed. The reason for this is presumably as follows.

When an outer peripheral surface of a conductive member is contaminated as a result of operation, the conductivity in the contaminated region becomes different from the conductivity in the un-contaminated region. Due to this difference, resistance non-uniformity may arise.

In particular, when a conductive member is used as a charging member that charges an image supporting body of an electrophotographic image forming apparatus and images are repeatedly formed, the outer peripheral surface of the conductive member is sometimes gradually contaminated with contaminants. An example of the contaminant is an external additive for a toner. Specifically, for example, it is presumed that the outer peripheral surface of the conductive member used as a charging member becomes contaminated when an external additive for a toner and the like remaining on the image supporting body migrates to the charging member. Once the outer peripheral surface of the conductive member is contaminated with highly insulating contaminants, such as an external additive for a toner, the conductivity of the contaminated region is decreased (resistance is increased) while the conductivity of the un-contaminated region remains high (low resistance), and resistance non-uniformity is likely to occur due to this difference. The contaminants on the outer peripheral surface of the conductive member gradually accumulate with use, and it is presumed that the distribution of the resistance of the conductive member changes with the history of use.

When an image is formed by using the conductive member having resistance non-uniformity as the charging member, insulating contaminants come between the charging member and the image supporting body at the time of charging the image supporting body and charge non-uniformity may result. When the image supporting body is charged in a non-uniform manner, the image density non-uniformity is likely to occur due to charge non-uniformity.

In contrast, in this exemplary embodiment, the area fraction of the insulating particles in the surface layer is 50% or more and 70% or less or about 50% or more and about 70% or less. That is, before the conductive member is used in operation, the surface layer contains insulating particles in a quantity larger than in the related art. Thus, even when the outer peripheral surface of the conductive member is contaminated with insulating contaminants, the change in conductivity of the contaminated region remains small since the conductivity therein is inherently low (resistance is inherently high). The difference in conductivity (difference in resistance) between the contaminated region and the non-contaminated region is also small. In other words, presumably, the distribution of the resistance of the conductive member does not change very much by contamination and this suppresses occurrence of non-uniformity in resistance.

When an image is formed by using a conductive member, whose resistance non-uniformity is suppressed, as a charging member, charge non-uniformity is suppressed and thus image density non-uniformity resulting from the charge non-uniformity is suppressed.

It is presumed that since the area fraction of the insulating particles in the surface layer of the conductive member of this exemplary embodiment is 50% or more and 70% or less, resistance non-uniformity resulting from contamination with insulating contaminants is suppressed.

The area fraction of the insulating particles in the surface layer is measured as follows.

A section sample is prepared from the surface layer of the conductive member taken in the thickness direction by a cryo microtome method. The sample is observed with a scanning electron microscope. Ten 4 μm×4 μm regions are arbitrarily selected. The area of the region occupied by the insulating particles is measured for each region, and the average value is assumed to be the "area fraction of the insulating particles in the surface layer". If the thickness of the surface layer is less than 4 μm, the number of regions to be observed is increased so that the total area of the observation remains the same.

In this exemplary embodiment, because the area fraction of the insulating particles in the surface layer is within the above-described range, resistance non-uniformity caused by insulating contaminants is less compared to when the area fraction is below the described range and durability of the surface layer is high compared to when the area fraction is beyond the described range. Thus, the surface layer is easy to maintain as a film.

The conductive member according to the exemplary embodiment may include only a substrate, an elastic layer, and a surface layer. Alternatively, for example, an intermediate layer (adhesive layer) may be disposed between the elastic layer and the substrate or another intermediate layer (for example, a resistance adjusting layer or a migration preventing layer) may be disposed between the elastic layer and the surface layer.

Figure 2:
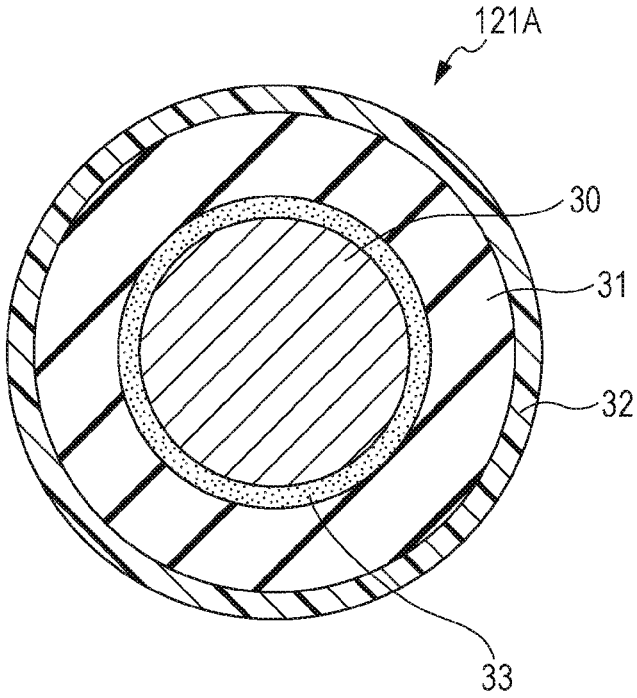
FIG. 2 is a schematic cross-sectional view of the example of the conductive member according to the exemplary embodiment.

The conductive member according to the exemplary embodiment will now be described in detail with reference to drawings. FIG. 1 is a schematic perspective view illustrating an example of a conductive member according to this exemplary embodiment. FIG. 2 is a schematic cross-sectional view of the conductive member illustrated in FIG. 1 taken along line II-II.

Referring to FIGS. 1 and 2, a conductive member 121A of the exemplary embodiment is a roller-shaped member (charging roller) that includes, for example, a substrate 30 (shaft), an adhesive layer 33 on the outer peripheral surface of the substrate 30, an elastic layer 31 on the outer peripheral surface of the adhesive layer 33, and a surface layer 32 on the outer peripheral surface of the elastic layer 31.

The constitutional elements of the conductive member according to the exemplary embodiment are described in detail below. In the description below, the reference numerals are omitted.

Substrate

The substrate is a member (shaft) that functions as an electrode and a supporting member of the conductive member.

Examples of the material for the substrate include metals such as iron (free-cutting steel or the like), copper, brass, stainless steel, aluminum, and nickel. A member (for example, a resin member or a ceramic member) having a plated outer surface or a member (for example, a resin member or a ceramic member) containing a dispersed conductive agent may also be used as the substrate.

The substrate may be a hollow member (a cylindrical member) or a solid member (columnar member). The substrate may be a conductive member.

For the purposes of this specification, "conductive" means that the volume resistivity at 20° C. is less than $1\times10^{14}$ Ω·cm.

Elastic Layer

The elastic layer contains, for example, an elastic material, a conductive agent, and other additives.

Examples of the elastic material include isoprene rubber, chloroprene rubber, epichlorohydrin rubber, butyl rubber, polyurethane, silicone rubber, fluorine rubber, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene-propylene-diene terpolymer rubber (EPDM), acrylonitrile-butadiene copolymer rubber (NBR), natural rubber, and blend rubbers of the foregoing. Among them, polyurethane, silicone rubber, EPDM, epichlorohydrin-ethylene oxide copolymer rubber, epichlorohydrin-ethylene oxide-allyl glycidyl ether copolymer rubber, NBR, and blend rubbers of the foregoing may be used. The elastic material may be foamed or unfoamed.

Examples of the conductive agent include an electron conductive agent and an ion conductive agent.

Examples of the electron conductive agent include powders of the followings: carbon black such as Ketjen black and acetylene black; pyrolytic carbon and graphite; metals and alloys such as aluminum, copper, nickel, and stainless steel; conductive metal oxides such as tin oxide, indium oxide, titanium oxide, tin oxide-antimony oxide solid solution, and tin oxide-indium oxide solid solution; and insulating substances having conductive surfaces.

Examples of the ion conductive agent include perchlorates or chlorates of oniums such as tetraethylammonium and lauryltrimethylammonium; and perchlorates and chlorates of alkaline earth metals and alkali metals such as lithium and magnesium.

These conductive agents may be used alone or in combination.

Specific examples of the carbon black include "Special Black 350", "Special Black 100", "Special Black 250", "Special Black 5", "Special Black 4", "Special Black 4A", "Special Black 550", "Special Black 6", "Color Black FW200", "Color Black FW2", and "Color Black FW2V" all produced by Orion Engineered Carbons LLC, and "MONARCH 880", "MONARCH 1000", "MONARCH 1300", "MONARCH 1400", "MOGUL-L", and "REGAL 400R" all produced by Cabot Corporation.

The average particle diameter of the conductive agent is, for example, 1 nm or more and 200 nm or less. The average particle diameter is determined form a sample taken from the elastic layer. The sample is observed with an electron microscope, diameters (longest axes) of one hundred particles of the conductive agent are measured, and the average thereof (number-average) is assumed to be the average particle diameter.

The amount of the conductive agent to be added is not particularly limited and may be in the range of 1 part by weight or more and 30 parts by weight or less relative to 100 parts by weight of the elastic material when the conductive agent is an electron conductive agent. The amount may be in the range of 15 parts by weight or more and 25 parts by weight or less. When the conductive agent is an ion conductive agent, the amount thereof may be in the range of 0.1 parts by weight or more and 5.0 parts by weight or less or may be in the range of 0.5 parts by weight or more and 3.0 parts by weight or less relative to 100 parts by weight of the elastic material.

Examples of other additives added to the elastic layer include common materials that can be blended into the elastic layer, such as a softener, a plasticizer, a curing agent, a vulcanizing agent, a vulcanization accelerator, an antioxidant, a surfactant, a coupling agent, and a filler (silica, calcium carbonate, etc.).

The volume resistivity of the elastic layer when the elastic layer also serves as a resistance adjusting layer may be $10^3$ Ω·cm or more and less than $10^{14}$ Ω·cm, $10^5$ Ω·cm or more and $10^{12}$ Ω·cm or less, or $10^7$ Ω·cm or more and $10^{12}$ Ωcm or less.

The volume resistivity of the elastic layer is a value measured by the following procedure.

That is, a sheet-shaped measurement sample is taken from the elastic layer. Using a measurement jig (R12702A/B Resistivity Chamber produced by ADVANTEST CORPORATION) and a high resistance meter (R8340A digital ultra high resistance/micro current meter produced by ADVANTEST CORPORATION) according to Japanese Industrial Standards (JIS) K 6911 (1995), a voltage is applied to the measurement sample for 30 seconds so that the electric field (applied voltage/composition sheet thickness) is 1000 V/cm and then the current value is substituted into the equation below to determine the volume resistivity:

Volume resistivity (Ω·cm)=(19.63×applied voltage (V))/(current value (A)×measurement sample thickness (cm))

The thickness of the elastic layer is, for example, 1 mm or more and 15 mm or less, may be 2 mm or more and 10 mm or less, or may be 2 mm or more and 5 mm or less, although the thickness depends on the apparatus in which the conductive member is used.

The thickness of the elastic layer is a value measured by the following procedure.

The elastic layer is sampled from three places, namely, a position 20 mm from one end in the axial direction, a position 20 mm from the other end in the axial direction, and a center in the axial direction, by cutting the elastic layer with a single-edged knife. A cross-section of each cut-out sample is observed at an appropriate magnification of 5 to 50 depending on the thickness to measure the thickness, and the average value is assumed to be the thickness of the elastic layer. VHX-200 Digital Microscope produced by KEYENCE CORPORATION is used for measurement.

Adhesive Layer

The adhesive layer is an optional layer. For example, the adhesive layer is formed of a composition that contains an adhesive (resin or rubber). The adhesive layer may be formed of a composition that contains an adhesive and other additives such as a conductive agent.

Examples of the resin include polyurethane resins, acrylic resins (for example, polymethyl methacrylate resins and polybutyl methacrylate resins), polyvinyl butyral resins, polyvinyl acetal resins, polyarylate resins, polycarbonate resins, polyester resins, phenoxy resins, polyvinyl acetate resins, polyamide resins, polyvinyl pyridine resins, and cellulose resins.

Other examples of the resin include butadiene resins (RB), polystyrene resins (for example, styrene-butadiene-styrene elastomers (SBS)), polyolefin resins, polyester resins, polyurethane resins, polyethylene resins (PE), polypropylene resins (PP), polyvinyl chloride resins (PVC), acrylic resins, styrene-vinyl acetate copolymer resins, butadiene acrylonitrile copolymer resins, ethylene-vinyl acetate copolymer resins, ethylene-ethyl acrylate copolymer resins, ethylene methacrylic acid (EMAA) copolymer resins, and modified resins of the foregoing.

Examples of the rubber include ethylene-propylene-diene terpolymer rubber (EPDM), polybutadiene, natural rubber, polyisoprene, styrene butadiene rubber (SBR), chloroprene rubber (CR), nitrile butadiene rubber (NBR), silicone rubber, urethane rubber, and epichlorohydrin rubber.

Among these, chloroprene rubber, epichlorohydrin rubber, chlorosulfonated polyethylene, chlorinated polyethylene, or the like may be used as the resin or rubber.

Examples of the conductive agent include conductive powders of the following: carbon black such as Ketjen black and acetylene black; pyrolytic carbon and graphite; conductive metals and alloys such as aluminum, copper, nickel, and stainless steel; conductive metal oxides such as tin oxide, indium oxide, titanium oxide, tin oxide-antimony oxide solid solution, and tin oxide-indium oxide solid solution; and insulating substances having conductive surfaces.

The average particle diameter of the conductive agent may be 0.01 μm or more and 5 μm or less, 0.01 μm or more and 3 μm or less, or 0.01 μm or more and 2 μm or less.

The average particle diameter is measured by cutting out a sample from the adhesive layer, observing the sample with an electron microscope, measuring the diameters (longest axes) of one hundred particles of the conductive agent, and averaging the results.

The conductive agent content relative to 100 parts by weight of the adhesive layer may be 0.1 parts by weight or more and 6 parts by weight or less, 0.5 parts by weight or more and 6 parts by weight or less, or 1 part by weight or more 3 parts by weight or less.

Examples of the additives other than the conductive agent include a crosslinking agent, a curing accelerator, an inorganic filler, an organic filler, a flame retardant, an antistatic agent, a conductivity imparting agent, a lubricant, a slidability imparting agent, a surfactant, a coloring agent, and an acid receptor. Two or more of these additives may be selected and contained.

Surface Layer

The surface layer contains a resin and insulating particles, and if needed, may contain a conductive agent and other additives.

Examples of the resin used in the surface layer include acrylic resins, cellulose resins, polyamide resins, copolymer nylons, polyurethane resins, polycarbonate resins, polyester resins, polyethylene resins, polyvinyl resins, polyarylate resins, styrene butadiene resins, melamine resins, epoxy resins, urethane resins, silicone resins, fluorine resins (for example, tetrafluoroethylene perfluoroalkyl vinyl ether copolymer, ethylene tetrafluoride-propylene hexafluoride copolymer, and polyvinylidene fluoride), and urea resins.

The copolymer nylons are copolymers that contain, as a polymerization unit, one or more than one units selected from 610 nylon, 11 nylon, and 12 nylon. As other polymerization units, 6 nylon, 66 nylon, or the like may also be contained.

An elastic material added to the elastic layer may be used as this resin.

The resin to be used in the surface layer may be a polyamide resin (nylon) or, more specifically, a methoxymethylated polyamide resin (methoxymethylated nylon) from the viewpoints of the electrical properties of the surface layer, resistance to contamination, appropriate hardness, maintainability of mechanical strength, dispersibility of the conductive agent, a film forming property, etc.

These resins may be used alone or in combination.

When two or more resins are used in the surface layer, the surface layer may have a sea-island structure with a first resin constituting the sea and a second resin constituting the islands.

The sea-island structure is formed by adjusting the difference in solubility parameter (SP value) between the first resin and the second resin and the mixing ratio of the first resin and the second resin. The difference in SP value between the first resin and the second resin may be 2 or more and 10 or less since a sea-island structure is smoothly formed at this difference. The mixing ratio of the first resin and the second resin may be 2 to 20 parts by weight of the second resin with respect to 100 parts by weight of the first resin from the viewpoint of forming islands of appropriate size. In some cases, the amount of the second resin may be 5 to 15 parts by weight.

In this exemplary embodiment, the solubility parameter (SP value) is calculated by the method described in VII 680 to 683 of Polymer Handbook, 4th edition, John Wiley & Sons. The solubility parameters of the major resins are described in VII 702 to 711 of the same book.

When the surface layer has the sea-island structure described above, specific examples of the first resin include those resins that are described above as example resins used in the surface layer. From the viewpoints of the electrical properties of the surface layer, resistance to contamination, appropriate hardness, maintainability of mechanical strength, dispersibility of the conductive agent, a film forming property, etc., the first resin may be a polyamide resin (nylon) or, more specifically, a methoxymethylated polyamide resin (methoxymethylated nylon).

Examples of the second resin include polyvinyl butyral resins, polystyrene resins, and polyvinyl alcohols. These may be used alone or in combination.

The insulating particles used in the surface layer may be any insulating particles. An example thereof is inorganic particles.

Specific examples of the inorganic particles include particles containing at least one selected from $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, $MgSO_4$, $10CaO.3P_2O_5.H_2O$, glass, and mica.

Resin particles may also be used as the insulating particles. Specific examples of the resin particles include particles of polystyrene resins, polymethyl methacrylate (PMMA), melamine resins, fluorine resins, and silicone resins.

The insulating particles may be inorganic particles, or, in particular, particles including $SiO_2$, $TiO_2$, $Al_2O_3$, glass, or mica, or particles including $SiO_2$ from the viewpoint of suppressing resistance non-uniformity.

The volume resistivity of the insulating particles at 20° C. may be any value equal to or more than $1\times10^{14}$ Ω·cm. From the viewpoint of suppressing resistance non-uniformity, the volume resistivity may be $1\times10^{14}$ Ω·cm or more and $1\times10^{19}$ Ω·cm or less, or $1\times10^{16}$ Ω·cm or more and $1\times10^{18}$ Ω·cm or less.

The volume resistivity of the insulating particles is measured as follows. The measurement environment is an environment at a temperature of 20° C. and a relative humidity (RH) of 50%.

First, the insulating particles are separated from the layer. The separated insulating particles to be measured are placed on a surface of a circular jig equipped with a 20 $cm^2$ electrode plate so as to form an insulating particle layer having a thickness of about 1 mm or more and 3 mm or less. Another 20 $cm^2$ electrode plate is placed on the insulating particle layer to sandwich the insulating particle layer. To eliminate gaps between the insulating particles, a 4 kg load is placed on the electrode plate on the insulating particle layer and then the thickness (cm) of the insulating particle layer is measured. The two electrodes above and below the insulating particle layer are connected to an electrometer and a high-voltage power supply. A high voltage is applied between the two electrodes so that the electric field reaches a particular value, and the value of current (A) that flows at this time is measured to calculate the volume resistivity (Ω·cm) of the insulating particles. The equation used for calculating the volume resistivity (Ω·cm) of the insulating particles is as follows:

$$\rho=E\times20/(I-I_0)/L$$

where ρ represents the volume resistivity (Ω·cm) of the insulating particles, E represents the applied voltage (V), I represents the current value (A), $I_0$ represents the current value (A) at an applied voltage of 0 V, and L represents the thickness (cm) of the insulating particle layer. In this evaluation, the volume resistivity under an application voltage of 1,000 V is used.

The number-average particle diameter of the insulating particles is, for example, 0.01 μm or more and 3.0 μm or less, 0.05 μm or more and 2.0 μm or less, or 0.1 μm or more and 1 μm or less.

When the number-average particle diameter of the insulating particles is within the above-described range, contamination of the image supporting body and the conductive member is less compared to when the number-average particle diameter is below this range, and adverse effects of the insulating particles detached from the conductive member on the image are less compared to when the number-average particle diameter is beyond this range.

The number-average particle diameter of the insulating particles is calculated by observing a cross-section as in measuring the area fraction of the insulating particles in the surface layer described above, measuring the diameters (longest axes) of one hundred insulating particles, and averaging the results.

The insulating particle content in the surface layer may be any value as long as the area fraction of the insulating particles is within the above-described range. For example, the insulating particle content may be 40% by weight or more and 90% by weight or less or may be 50% by weight or more and 80% by weight or less.

The area fraction of the insulating particles in the surface layer is 50% or more and 70% or less, or may be, from the viewpoints of suppressing resistance non-uniformity and surface layer durability, 53% or more and 70% or less or 55% or more and 70% or less.

Examples of the conductive agent used in the surface layer include an electron conductive agent and an ion conductive agent. Examples of the electron conductive agent include powders of the followings: carbon black such as Ketjen black and acetylene black; pyrolytic carbon and graphite; conductive metals and alloys such as aluminum, copper, nickel, and stainless steel; conductive metal oxides such as tin oxide, indium oxide, titanium oxide, tin oxide-antimony oxide solid solution, and tin oxide-indium oxide solid solution; and insulating substances having conductive surfaces. Examples of the ion conductive agent include perchlorates and chlorates of oniums such as tetraethylammonium and lauryltrimethylammonium; and perchlorates and chlorates of alkaline earth metals and alkali metals such as lithium and magnesium. The conductive agents may be used alone or in combination.

The conductive agent may be carbon black. The carbon black may be Ketjen black, acetylene black, an oxidized carbon black having pH of 5 or less, or the like. Specific examples of such carbon black include "Special Black 350", "Special Black 100", "Special Black 250", "Special Black 5", "Special Black 4", "Special Black 4A", "Special Black 550", "Special Black 6", "Color Black FW200", "Color Black FW2", and "Color Black FW2V" all produced by Orion Engineered Carbons LLC, and "MONARCH 880", "MONARCH 1000", "MONARCH 1300", "MONARCH 1400", "MOGUL-L", and "REGAL 400R" all produced by Cabot Corporation.

The conductive agent content in the surface layer is, for example, 3% by weight or more and 30% by weight or less relative to the weight of the entire rest of the surface layer after separation of the insulating particles. From the viewpoint of chargeability of the conductive member, the conductive agent content may be 5% by weight or more and 20% by weight or less.

Examples of the other additives used in the surface layer include known compounds such as a plasticizer, a softener, a vulcanization accelerator, and a vulcanizing agent.

The thickness of the surface layer is, for example 1 μm or more and 30 μm or less. From the viewpoint of maintaining the mechanical strength, the thickness may be 1 μm or more and 20 μm or less, or may be 3 μm or more and 15 μm or less. The thickness of the surface layer is a value measured by the same procedure as one for measuring the thickness of the elastic layer.

The surface layer may have cracks. The "cracks" are groove-like regions that extend from the outer peripheral surface of the surface layer toward the elastic layer.

Figure 3:
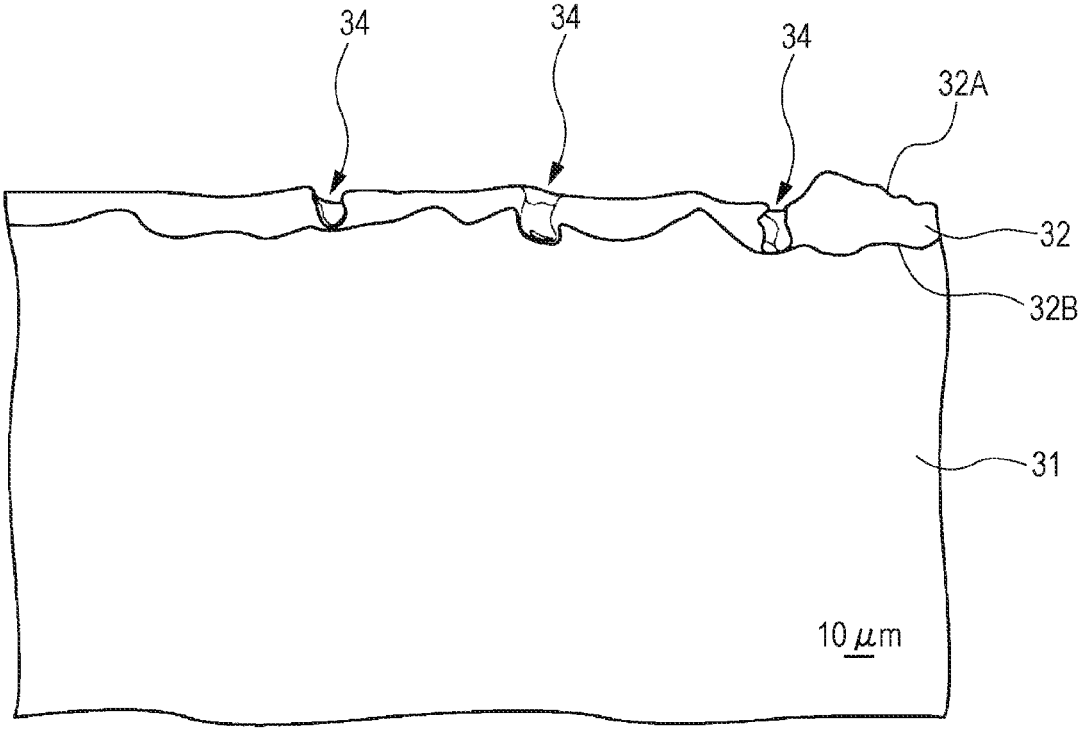
FIG. 3 is a schematic diagram of a cross section of a surface layer and an elastic layer of the example of the conductive member according to the exemplary embodiment taken in a thickness direction.
Figure 4:
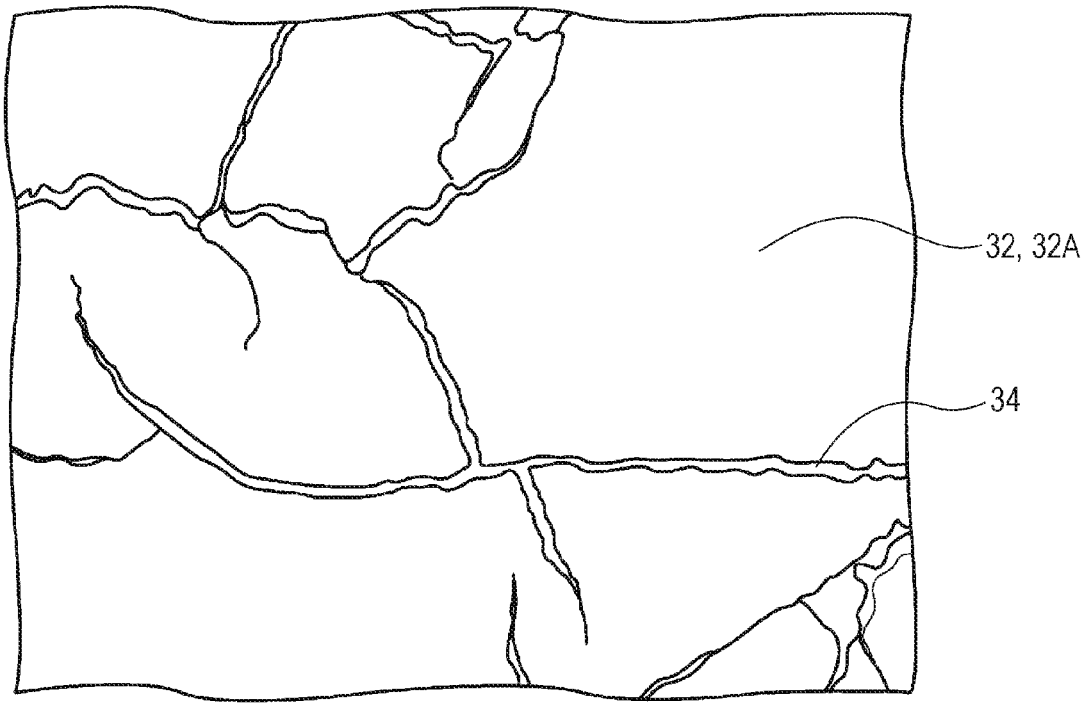
FIG. 4 is a schematic diagram illustrating an outer peripheral surface of the surface layer of the example of the conductive member according to the exemplary embodiment.

FIG. 3 is a schematic diagram of a cross-section of the surface layer and the elastic layer of the conductive member of the exemplary embodiment taken in the thickness direction and FIG. 4 is a schematic diagram illustrating the outer peripheral surface of the surface layer of the conductive member of the exemplary embodiment.

As illustrated in FIG. 3, several cracks 34 penetrating through the surface layer 32 are present in the surface layer 32 of the conductive member. The cracks 34 are grooves that penetrate from an outer peripheral surface 32A of the surface layer 32 toward the center in the radial direction and reach as far as an interface 32B between the surface layer 32 and the elastic layer 31.

Although all of the cracks 34 illustrated in FIG. 3 penetrate through the surface layer 32, this may be otherwise. The cracks 34 may be any groove-shape cracks formed in the outer peripheral surface 32A of the surface layer 32 and do not have to penetrate through the surface layer 32.

The cracks 34 may be any cracks extending from the outer peripheral surface 32A of the surface layer 32 toward the elastic layer 31 and do not have to be perpendicular to the outer peripheral surface 32A.

The shape of the cracks 34 in the outer peripheral surface 32A of the surface layer 32 of the conductive member is not particularly limited. For example, as illustrated in FIG. 4, the cracks 34 may have a shape resembling cracks formed in the dried-up land, i.e., a random shape. The cracks 34 may include cracks that intersect one another in the outer peripheral surface 32A of the surface layer 32 and/or cracks that do not intersect with other cracks.

In this exemplary embodiment, cracks in the surface layer improve the chargeability of the conductive member.

As discussed above, according to the conductive member of the exemplary embodiment, the area fraction of the insulating particles in the surface layer is in the above-described range and thus the volume resistivity of the surface layer tends to be high compared to the conductive members of related art. However, when the surface layer has cracks, the conductivity of the elastic layer smoothly contributes to the charging capacity of the conductive member, and thus, presumably, high chargeability is obtained while suppressing the resistance non-uniformity due to contamination. When a conductive member that achieves less resistance non-uniformity and high chargeability is used as a charging member to form an image, image density non-uniformity caused by charge non-uniformity caused by resistance non-uniformity and fogging in the non-image portion caused by a decrease in chargeability are both suppressed.

An example of a method for obtaining a surface layer having cracks is a method that involves adjusting the amount of the insulating particles added to the surface layer. The amount of the insulating particles that helps form cracks in the surface layer depends on conditions such as particle diameter and the resin type of the insulating particles. For example, the amount of the insulating particles may be set to a level such that the area fraction of the insulating particles in the surface layer is in the range of 50% or more and 70% or less.

The area fraction of the cracks in the surface layer is not particularly limited and, for example, is 0.1% or more and 30% or less, may be 0.1% or more and 20% or less, or may be 0.1% or more and 15% or less. The area fraction may be about 0.1% or more and about 30% or less, may be about 0.1% or more and about 20% or less, or may be about 0.1% or more and about 15% or less.

The area fraction of the cracks in the surface layer is the ratio of the total area of the cracks to the entire area of the outer peripheral surface of the surface layer.

When the area fraction of the cracks is within the above-described range, durability of the surface layer is improved and the outer peripheral surface tends to be less contaminated compared to when the area fraction of the cracks is beyond this range. The chargeability is improved compared to when the area fraction of the cracks is below this range.

The width of each of the cracks in the surface layer is not particularly limited and is, for example, 0.1 μm or more and 20 μm or less or 0.1 μm or more and 10 μm or less.

The width of a crack is an average of the widths of the crack in the outer peripheral surface of the surface layer measured at 100 μm intervals in the length direction of the crack. The width of one crack may differ in the thickness direction and the depth direction.

When the widths of the cracks are within the above-described range, the outer peripheral surface is less contaminated compared to when the widths are beyond the range and the chargeability is improved compared to when the widths are below the range.

The presence/absence of the cracks in the surface layer, the area fraction of the cracks, and the widths of the cracks can be determined by analyzing an image obtained by observation of the outer peripheral surface of the surface layer (for example, a 500 μm×500 μm area) with an electron microscope.

The area fraction of the cracks in the surface layer and the widths of the cracks can be adjusted by adjusting the amount of the insulating particles added to the surface layer.

Method for Producing Conductive Member

First, for example, a roller-shaped member formed of a cylindrical or columnar substrate and an elastic layer on the outer peripheral surface of the substrate is prepared. This roller-shaped member may be prepared by any method. For example, a mixture of a rubber material and, if needed, a conductive agent and other additives may be wound around the substrate and heated to perform vulcanization so as to form an elastic layer.

The method for forming a surface layer on the outer peripheral surface of the elastic layer may be any. For example, a dispersion prepared by dissolving and dispersing a resin, insulating particles, and, if needed, a conductive agent and other additives in a solvent may be applied to the outer peripheral surface of the elastic layer, and the applied dispersion may be dried to form the surface layer. Examples of the method for applying the dispersion include a blade coating method, a Meyer bar coating method, a spray coating method, a dip coating method, a bead coating method, an air knife coating method, and a curtain coating method.

Although a roller-shaped conductive member is described as an example of the conductive member of the exemplary embodiment, the conductive member of the exemplary embodiment is not limited to this and may be an endless-belt-shaped member, a sheet-shaped member, or a blade-shaped member.

Charging Device

Figure 5:
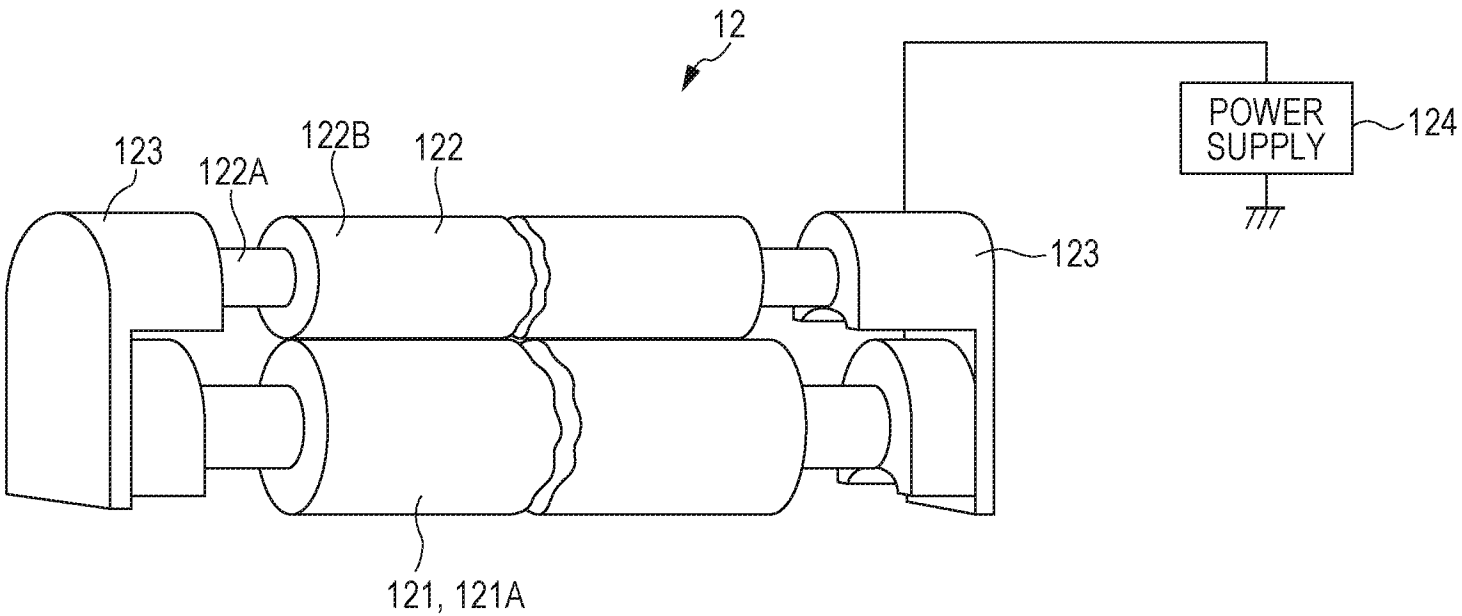
FIG. 5 is a schematic perspective view of a charging device used in an exemplary embodiment.

The charging device used in an exemplary embodiment will now be described. FIG. 5 is a schematic perspective view of an example of the charging device used in the exemplary embodiment. The charging device used in the exemplary embodiment is an example in which the conductive member of the exemplary embodiment is used as the charging member.

Referring to FIG. 5, a charging device 12 used in the exemplary embodiment includes a charging member 121 and a cleaning member 122 in contact with each other, for example. Two ends of the shaft (substrate) of the charging member 121 and two ends of a shaft 122A of the cleaning member 122 in the axial direction are supported by conductive bearings 123 such that the charging member 121 and the cleaning member 122 are rotatable. A power supply 124 is connected to one of the conductive bearings 123. The charging device used in the exemplary embodiment is not limited to this structure. For example, the cleaning member 122 may be omitted.

The cleaning member 122 is provided to clean the surface of the charging member 121 and has, for example, a roller shape. The cleaning member 122 is constituted by, for example, a shaft 122A and an elastic layer 122B on the outer peripheral surface of the shaft 122A.

The shaft 122A is a conductive cylindrical or columnar member. Examples of the material for the shaft 122A include metals such as iron (free-cutting steel or the like), copper, brass, stainless steel, aluminum, and nickel. Other examples of the shaft 122A include a member (for example, a resin or ceramic member) with a plated outer peripheral surface and a member (for example, a resin or ceramic member) containing a dispersed conductive agent.

The elastic layer 122B is formed of a foamed body having a porous three-dimensional structure. The elastic layer 122B may have pores inside and protrusions and recesses on the surface, and may be elastic. Specific examples of the material for the elastic layer 122B include expandable resin and rubber materials such as polyurethane, polyethylene, polyamide, olefins, melamine and propylene, acrylonitrile-butadiene copolymer rubber (NBR), ethylene-propylene-diene copolymer rubber (EPDM), natural rubber, styrene butadiene rubber, chloroprene, silicone, and nitrile.

Among these expandable resin and rubber materials, polyurethane may be used as the material from the viewpoint of effectively removing foreign matter such as a toner and external additives by friction with the charging member 121, from the viewpoint of avoiding scratches on the surface of the charging member 121 caused by friction with the cleaning member 122, and from the viewpoint of suppressing tearing and breaking over a long period of time.

The polyurethane may be any polyurethane. Examples of the polyurethane include reaction products between a polyol (for example, polyester polyol, polyether polyol, or acryl polyol) and an isocyanate (for example, 2,4-tolylene diisocyanate, 2,6-tolylene diisocyanate, 4,4-diphenylmethane diisocyanate, tolidine diisocyanate, or 1,6-hexamethylene diisocyanate) and reaction products obtained by using chain extenders of the foregoing (for example, 1,4-butanediol and trimethylolpropane). A polyurethane is usually foamed by using a foaming agent (water or an azo compound such as azodicarbonamide or azobisisobutyronitrile).

The conductive bearings 123 rotatably support the charging member 121 and the cleaning member 122 and retain the axis-to-axis distance between the conductive bearing 123 and the charging member 121. The conductive bearings 123 may be formed of any conductive material and may take any form. For example, conductive bearings and conductive sliding bearings may be used.

The power supply 124 is a device that charges the charging member 121 and the cleaning member 122 by applying a voltage to the conductive bearing 123 and may be any known high-voltage power supply.

Image Forming Apparatus and Process Cartridge

An image forming apparatus according to an exemplary embodiment includes an image supporting body, a charging device that charges the image supporting body, a latent image forming device that forms a latent image on the charged surface of the image supporting body, a developing device that forms a toner image by developing the latent image on the surface of the image supporting body with a toner, and a transfer device that transfers the toner image on the surface of the image supporting body onto a recording medium. A charging device equipped with the conductive member according to the exemplary embodiment is used as the charging device of this image forming apparatus.

The toner used for forming the image may contain an external additive whose volume resistivity is about the same as (for example, 0.9 to 1.1 times) the volume resistivity of the insulating particles used in the surface layer of the conductive member of the exemplary embodiment. In this manner, resistance non-uniformity caused by contamination of the outer peripheral surface of the conductive member of the exemplary embodiment by the external additive of the toner is suppressed and the image density non-uniformity caused by charge non-uniformity caused by resistance non-uniformity is suppressed.

A process cartridge according to an exemplary embodiment is detachably attachable to an image forming apparatus and includes an image supporting body and a charging device that charges the image supporting body. A charging device equipped with the conductive member of the exemplary embodiment, that is, the charging device used in the exemplary embodiment, is used as the charging device of the process cartridge.

Optionally, the process cartridge according to the exemplary embodiment may further include at least one device selected from a developing device that forms a toner image by developing a latent image on the surface of an image supporting body with a toner, a transfer device that transfers the toner image on the surface of the image supporting body onto a recording medium, and a cleaning device that removes a residual toner on the surface of the image supporting body after transfer.

Figure 6:
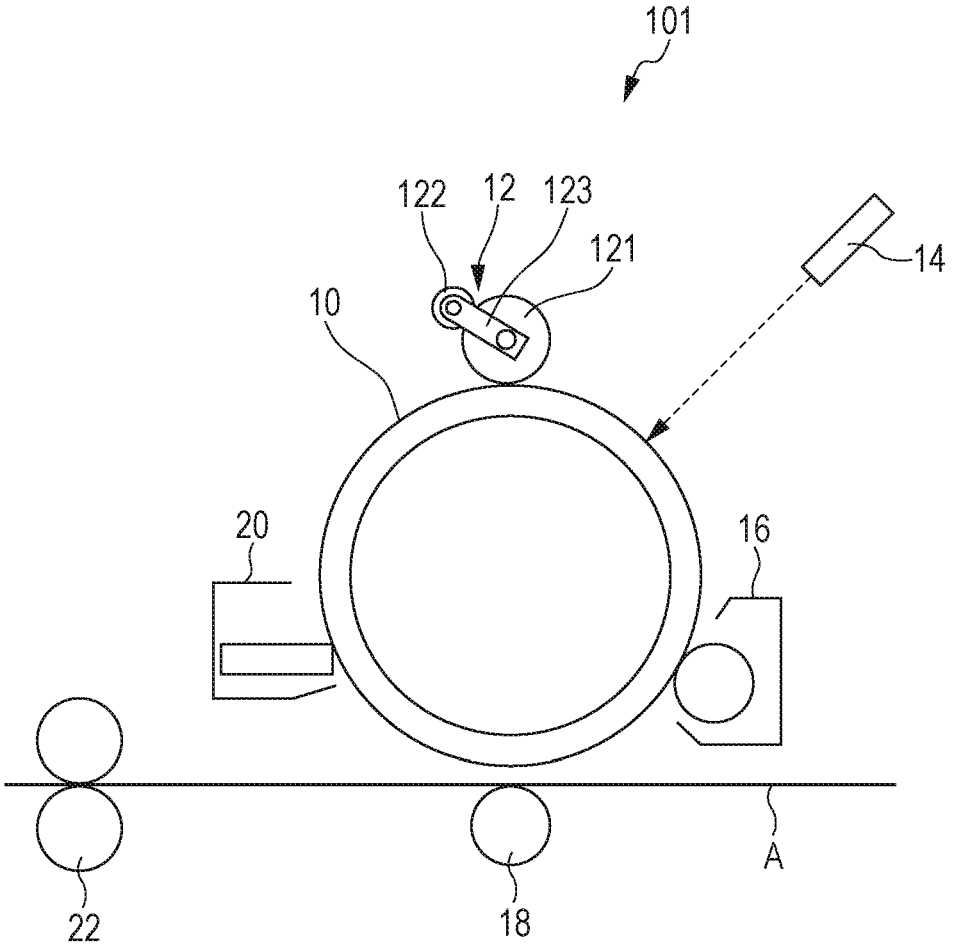
FIG. 6 is a schematic diagram illustrating an example of an image forming apparatus according to an exemplary embodiment.
Figure 7:
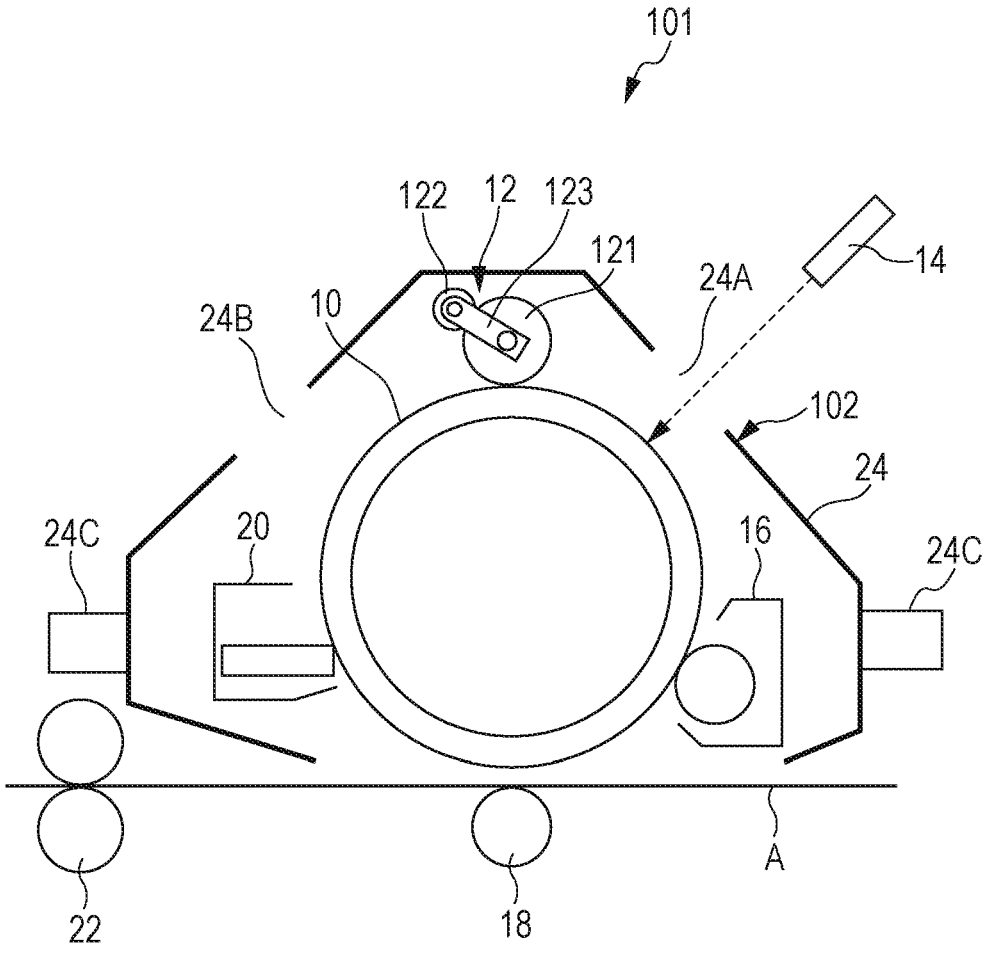
FIG. 7 is a schematic diagram illustrating an example of a process cartridge according to an exemplary embodiment.

The image forming apparatus and the process cartridge according to the exemplary embodiment are described below with reference to the drawings. FIG. 6 is a schematic diagram illustrating an example of the image forming apparatus of the exemplary embodiment. FIG. 7 is a schematic diagram illustrating an example of the process cartridge of the exemplary embodiment.

Referring to FIG. 6, an image forming apparatus 101 includes an image supporting body 10. A charging device 12 that charges the image supporting body 10, an exposing device 14 that forms a latent image by exposing the image supporting body 10 charged by the charging device 12, a developing device 16 that forms a toner image by developing with a toner the latent image formed by using the exposing device 14, a transfer device 18 that transfers onto a recording medium A the toner image formed by the developing device 16, a cleaning device 20 that removes a residual toner on the surface of the image supporting body 10 after transfer, and a fixing device 22 that fixes the toner image transferred onto the recording medium A by the transfer device 18.

The charging device 12 illustrated in FIG. 5 is used as the charging device 12 of the image forming apparatus 101, for example. Devices commonly used in electrophotographic image forming apparatuses are used as the image supporting body 10, the exposing device 14, the developing device 16, the transfer device 18, the cleaning device 20, and the fixing device 22 of the image forming apparatus 101. Examples of the devices are described below.

The image supporting body 10 may be any known photoreceptor. The image supporting body 10 may be an organic photoreceptor of a so-called separated function type in which a charge generation layer and a charge transport layer are separately provided, or a photoreceptor having a surface layer formed of a siloxane resin, a phenolic resin, a melamine resin, a guanamine resin, or an acrylic resin having a charge transport property and a crosslinked structure.

A laser optical system or a light-emitting diode (LED) array is used as the exposing device 14, for example.

The developing device 16 is, for example, a developing device that causes a developer supporting body having a developer layer on the surface to contact or approach the image supporting body 10 so as to attach the toner to the latent image on the surface of the image supporting body 10 to form a toner image. The development mode of the developing device 16 may be a development mode that uses a two-component developer.

Examples of the transfer device 18 include a non-contact transfer device such as a corotron or scorotron and a contact transfer device that transfers a toner image onto the recording medium A by bringing a conductive transfer roller into contact with the image supporting body 10 with the recording medium A therebetween.

The cleaning device 20 is a member that removes the toner, paper dust, foreign matter, etc., attaching on the surface of the image supporting body 10 by causing a cleaning blade to directly contact the surface. Instead of the cleaning blade, a cleaning brush, a cleaning roller, or the like may be used as the cleaning device 20.

The fixing device 22 may be a thermal fixing device that uses a heat roller. The thermal fixing device includes, for example, a fixing roller and a pressurizing roller or belt arranged to be in contact with the fixing roller. The fixing roller includes, for example, a cylindrical core with a built-in heater lamp for heating, and a releasing layer (for example, a heat-resistant resin coating layer or a heat-resistant rubber coating layer) on the outer peripheral surface of the cylindrical core. The pressurizing roller includes, for example, a cylindrical core and a heat-resistant elastic layer on the outer peripheral surface of the cylindrical core. The pressurizing belt includes, for example, a belt-shaped substrate and a heat-resistant elastic layer on the surface of the base.

The process for fixing an unfixed toner image may involve, for example, inserting, between the fixing roller and the pressurizing roller or belt, a recording medium A onto which the unfixed toner image has been transferred so that the toner image is fixed as a result of thermal fusion of the binder resin, the additives, and the like contained in the toner.

The image forming apparatus 101 is not limited to one having the above-described structure. For example, the image forming apparatus 101 may be an intermediate-transfer-type image forming apparatus that includes an intermediate transfer body or a tandem image forming apparatus in which image forming units for forming toner images of different colors are arranged in parallel.

Referring to FIG. 7, a process cartridge 102 according to an exemplary embodiment includes an image supporting body 10, a charging device 12, a developing device 16, and a cleaning device 20 integrated in a housing 24. The housing 24 has an opening 24A for exposure, an opening 24B for charge-erasing exposure, and an installation rail 24C. The process cartridge 102 is detachably attachable to the image forming apparatus 101.

In the description above, an image forming apparatus in which the conductive member of the exemplary embodiment is used as the charging device (the charging member of the charging device) is described as the image forming apparatus of the exemplary embodiment. Alternatively, the image forming apparatus of the exemplary embodiment may include the conductive member of the exemplary embodiment as the transfer device (the transfer member of the transfer device).

EXAMPLES

Exemplary embodiments will now be described in detail by using Examples. These Examples do not limit the scope of the exemplary embodiments. Unless otherwise noted, the "parts" means "parts by weight".

Example 1: Preparation of Charging Roller

Formation of Elastic Layer

A mixture prepared by adding 15 parts by weight of a conductive agent (carbon black, Asahi Thermal produced by ASAHI CARBON CO., LTD.), 1 part by weight of a vulcanizing agent (sulfur, 200 mesh, produced by Tsurumi Chemical Industry Co., Ltd.), and 2.0 parts by weight of a vulcanization accelerator (NOCCELER DM produced by OUCHI SHINKO CHEMICAL INDUSTRIAL CO., LTD.) to 100 parts by weight of an elastic material (epichlorohydrin-ethylene oxide-allyl glycidyl ether copolymer rubber), is kneaded with an open roller to obtain a composition for forming an elastic layer. The composition for forming an elastic layer is wound around an outer peripheral surface of a SUS303 shaft (substrate) 8 mm in diameter with an adhesive layer therebetween by using a press former. The substrate and the composition wound around the substrate are placed in a 180° C. furnace to be heat-treated for 30 minutes. As a result, an elastic layer having a thickness of 3.5 mm is formed on the adhesive layer on the substrate.

The adhesive layer is a layer (thickness: 15 μm) formed of an adhesive (serial No.: XJ150 produced by LORD Far East, Inc.).

The outer peripheral surface of the obtained elastic layer is polished. As a result, a conductive elastic roller having an elastic layer 3.0 mm in thickness and a diameter of 14 mm is obtained.

Formation of Surface Layer

One hundred parts by weight of a first resin solution (solid concentration: 8% by weight) prepared by dissolving a nylon resin (N-methoxymethylated nylon, FR-101 produced by NAMARIICHI CO., LTD.) serving as a first resin in a methanol/1-butanol (3:1 on a weight basis) mixed solvent, a second resin solution prepared by dissolving 10 parts by weight of a polyvinyl butyral resin (Denka Butyral produced by Denka Company Limited) serving as a second resin in a methanol/1-butanol (3:1 on a weight basis) mixed solvent, adding 8 parts by weight of carbon black (MONARCH 880 produced by Cabot Corporation), and stirring the resulting mixture for 30 minutes, 2 parts by weight of a curing agent (citric acid), and 90 parts by weight of silica particles having a number-average particle diameter of 0.1 μm are mixed. The resulting mixture is dispersed in a bead mill to obtain a dispersion.

The temperature of the dispersion is adjusted to 18.5° C., the dispersion is applied to the outer peripheral surface of the conductive elastic roller at an ambient temperature of 21° C. by dip coating, and the applied dispersion is held at the same temperature to dry.

Then heating is conducted at 160° C. for 20 minutes to form a surface layer having a thickness of 8 μm.

Examples 2 to 8 and Comparative Examples 1 to 3: Preparation of Charging Rollers Charging rollers are obtained as in Example 1 except that, in the "formation of surface layer" of Example 1, the type, number-average particle diameter, and added amount of the insulating particles are changed as indicated in Table. In the table, "-" indicates the absence of the corresponding component.

Example 9: Preparation of Charging Roller

A conductive elastic roller is obtained as in Example 1.

One hundred parts by weight of a first resin solution (solid concentration: 8% by weight) prepared by dissolving a nylon resin (N-methoxymethylated nylon, FR-101 produced by NAMARIICHI CO., LTD.) serving as a first resin in a methanol/1-butanol (3:1 on a weight basis) mixed solvent, 8 parts by weight of carbon black (MONARCH 880 produced by Cabot Corporation), 2 parts by weight of a curing agent (citric acid), and 54 parts by weight of silica particles having a number-average particle diameter of 0.1 μm are mixed. The resulting mixture is dispersed in a bead mill to obtain a dispersion.

The temperature of the dispersion is adjusted to 18.5° C., the dispersion is applied to the outer peripheral surface of the conductive elastic roller at an ambient temperature of 21° C. by dip coating, and the applied dispersion is held at the same temperature to dry.

Then heating is conducted at 160° C. for 20 minutes to form a surface layer having a thickness of 8 μm.

Evaluation of Charging Roller

Properties of Surface Layer

The area fraction of the insulating particles in the surface layer is measured with a scanning electron microscope (SEM) in the manner described above. The presence/absence of the cracks in the surface layer, the area fraction of the cracks, and the widths of the cracks are determined in the manner described above. The results are indicated in Table.

Evaluation of Resistance Non-Uniformity (Image Density Non-Uniformity)

The prepared charging roller is loaded into a process cartridge of a color copier, DocuCentre Color 450 produced by Fuji Xerox Co., Ltd., and a halftone image (image density: 50%) is output in a 10° C., 15% RH environment. The density non-uniformity on the 10th sheets and on the 10,000th sheet is observed with naked eye and the images are classified as follows. A toner that contains only the silica particles (number-average particle diameter: 0.3 μm, volume resistivity: $1\times10^{16}$ Ω·cm) as the external additive is used as the toner for forming the image.

G1 (AA): No density non-uniformity is observed.

G2 (A): Density non-uniformity barely recognizable under careful observation is observed at two or more positions.

G3 (B): Density non-uniformity barely recognizable under careful observation is observed at three or more positions but the non-uniformity is acceptable.

G4 (F): Non-uniformity is clearly recognizable and unacceptable.

Evaluation of Chargeability (Fogging)

The prepared charging roller is loaded into a process cartridge of a color copier, DocuCentre Color 450 produced by Fuji Xerox Co., Ltd. An image having an image portion and a non-image portion is output in a 10° C., 15% RH environment. Fogging in the non-image portion is observed on the 10th sheet and the 10,000th sheet. The images are classified as below. A toner that contains only the silica particles (number-average particle diameter: 0.3 μm, volume resistivity: $1\times10^{16}$ Ω·cm) as the external additive is used as the toner for forming the image.

G1 (A): No fogging is observed.

G2 (B): Fogging is barely recognizable under careful observation and is acceptable.

G3 (F): Fogging is clearly recognizable and is unacceptable.

TABLE

| | Insulating particle | | | | | Cracks | | | Image density non-uniformity | | Fogging | |
|---|---|---|---|---|---|---|---|---|---|---|---|---|
| | Type | Volume resistivity (Ω · cm) | Number-average particle diameter (μm) | Amount added (parts) | Area fraction (%) | Presence of cracks | Area fraction (%) | Width (μm) | 10th sheet | 10,000th sheet | 10th sheet | 10,000th sheet |
| Example 1 | Silica | $1 \times 10^{16}$ | 0.1 | 90 | 60 | Present | 8 | 4 | G1 (AA) | G2 (A) | G1 (A) | G1 (A) |
| Example 2 | Silica | $1 \times 10^{16}$ | 0.1 | 56 | 52 | Present | 5 | 3 | G2 (A) | G2 (A) | G1 (A) | G2 (B) |
| Example 3 | Silica | $1 \times 10^{16}$ | 0.1 | 130 | 70 | Present | 12 | 8 | G2 (A) | G2 (A) | G1 (A) | G1 (A) |
| Example 4 | Silica | $1 \times 10^{16}$ | 0.7 | 90 | 60 | Present | 18 | 15 | G2 (A) | G2 (A) | G1 (A) | G1 (A) |
| Example 5 | Silica | $1 \times 10^{16}$ | 0.05 | 90 | 60 | Present | 3 | 4 | G1 (AA) | G2 (A) | G1 (A) | G1 (A) |
| Example 6 | Titania | $1 \times 10^{16}$ | 0.05 | 170 | 60 | Present | 4 | 5 | G1 (AA) | G2 (A) | G1 (A) | G2 (B) |
| Example 7 | Alumina | $1 \times 10^{16}$ | 0.04 | 170 | 60 | Present | 2 | 3 | G1 (AA) | G2 (A) | G1 (A) | G2 (B) |
| Example 8 | PTFE resin | $1 \times 10^{16}$ | 0.1 | 46 | 60 | Present | 1 | 1 | G2 (A) | G2 (A) | G1 (A) | G2 (B) |
| Example 9 | Silica | $1 \times 10^{16}$ | 0.1 | 54 | 60 | Present | 3 | 1 | G1 (AA) | G2 (A) | G1 (A) | G1 (A) |
| Comparative Example 1 | Silica | $1 \times 10^{16}$ | 0.1 | 225 | 80 | Present | 21 | 20 | G3 (B) | G4 (F) | G3 (F) | G3 (F) |
| Comparative Example 2 | Silica | $1 \times 10^{16}$ | 0.1 | 25 | 41 | Present | 0.1 | 0.1 | G2 (A) | G4 (F) | G2 (B) | G3 (F) |
| Comparative Example 3 | — | — | — | 0 | 0 | Absent | — | — | G2 (A) | G4 (F) | G2 (B) | G3 (F) |

These results show that the image density non-uniformity caused by charge non-uniformity caused by resistance non-uniformity of the conductive member is suppressed in Examples compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive member comprising:

a substrate;

an elastic layer on the substrate; and a surface layer on the elastic layer, the surface layer containing a resin and insulating particles, wherein the insulating particles account for about 50% or more and about 70% or less of an area of a cross-section of the surface layer taken in a thickness direction, wherein the insulating particles are inorganic particles, wherein the surface layer has a crack, and wherein an area fraction of the crack relative to an entire outer peripheral surface of the surface layer is about 0.1% or more and about 30% or less.

2. The conductive member according to claim 1, wherein the insulating particles contain at least one selected from SiO2, TiO2, and Al2O3.

3. The conductive member according to claim 1, wherein the insulating particles are resin particles.

4. The conductive member according to claim 1, wherein an area fraction of the crack relative to an entire outer peripheral surface of the surface layer is about 0.1% or more and about 20% or less.

5. The conductive member according to claim 1, wherein an area fraction of the crack relative to an entire outer peripheral surface of the surface layer is about 0.1% or more and about 15% or less.

6. The conductive member according to claim 1, wherein the resin contains a polyamide resin.

7. The conductive member according to claim 1, wherein the resin contains a methoxymethylated polyamide resin.

8. A process cartridge detachably attachable to an image forming apparatus, comprising:

an image supporting body; and a charging device that charges the image supporting body and includes the conductive member according to claim 1.

9. An image forming apparatus comprising:

an image supporting body;

a charging device that charges the image supporting body and includes the conductive member according to claim 1;

a latent image forming device that forms a latent image on a charged surface of the image supporting body;

a developing device that forms a toner image by developing the latent image on the surface of the image supporting body with a toner; and a transfer device that transfers the toner image on the surface of the image supporting body onto a recording medium.

* * * * *